US010280550B2

(12) United States Patent
Leibman

(10) Patent No.: US 10,280,550 B2
(45) Date of Patent: May 7, 2019

(54) FLUID ADDITIVE DISPENSER

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 288 days.

(21) Appl. No.: 15/267,179

(22) Filed: Sep. 16, 2016

(65) Prior Publication Data

US 2018/0080166 A1 Mar. 22, 2018

(51) Int. Cl.

| | |
|---|---|
| ***D06F 39/02*** | (2006.01) |
| ***D06F 37/12*** | (2006.01) |
| ***D06F 39/08*** | (2006.01) |
| ***D06F 39/00*** | (2006.01) |
| *D06F 23/04* | (2006.01) |
| *D06F 33/02* | (2006.01) |

(52) U.S. Cl.

CPC ..... *D06F 39/028* (2013.01); *D06F 37/12* (2013.01); *D06F 39/005* (2013.01); *D06F 39/08* (2013.01); *D06F 23/04* (2013.01); *D06F 33/02* (2013.01); *D06F 2204/02* (2013.01); *D06F 2204/086* (2013.01); *D06F 2214/00* (2013.01)

(58) Field of Classification Search

None

See application file for complete search history.

(56) References Cited

U.S. PATENT DOCUMENTS

| | | | | |
|---|---|---|---|---|
| 9,003,588 | B2 * | 4/2015 | Amos | D06F 39/028 8/158 |
| 2007/0044517 | A1 * | 3/2007 | Yang | D06F 39/022 68/17 R |
| 2007/0131000 | A1 * | 6/2007 | Jeong | D06F 39/022 68/17 R |
| 2011/0120196 | A1 * | 5/2011 | Kim | D06F 39/02 68/17 R |
| 2011/0277515 | A1 | 11/2011 | Doh | |
| 2012/0125055 | A1 * | 5/2012 | Lee | D06F 39/02 68/17 R |
| 2012/0174632 | A1 * | 7/2012 | Sung | D06F 39/022 68/17 R |
| 2013/0327101 | A1 | 12/2013 | Leibman et al. | |

FOREIGN PATENT DOCUMENTS

| | | | |
|---|---|---|---|
| DE | 3712323 | A1 | 10/1988 |

* cited by examiner

*Primary Examiner* — Jason Y Ko
*Assistant Examiner* — Cristie J Tate-Sims
(74) *Attorney, Agent, or Firm* — Dority & Manning, P.A.

(57) ABSTRACT

A washing machine appliance and a fluid additive dispenser therefor. The washing machine appliance includes a wash tub and a wash basket rotatably mounted within the wash tub, a gap is defined between the wash tub and the wash basket. The fluid additive dispenser includes a reservoir with a siphon tube and a siphon cap. The siphon cap includes an overflow inlet. The fluid additive dispenser is in fluid communication with the wash tub and the wash basket only via an outlet of the siphon tube. The siphon tube outlet is positioned for directing fluid into the gap between the wash tub and the wash basket.

20 Claims, 6 Drawing Sheets

FLUID ADDITIVE DISPENSER

FIELD OF THE INVENTION

The present subject matter relates generally to fluid additive dispensers for appliances, e.g., washing machine appliances.

BACKGROUND OF THE INVENTION

Washing machine appliances generally form a wash fluid to clean clothing articles disposed within a wash basket of the appliance. The wash fluid can include water and various fluid additives, e.g., detergent, fabric softener, and/or bleach. The fluid additives can be mixed with water within a wash tub of the appliance in order to form the wash fluid.

To introduce fluid additive into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray or container mounted to a top panel of a vertical axis washing machine appliance can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

The washing machine appliance's wash basket is typically rotatably mounted within the wash tub. Thus, the wash basket spins within the wash tub during operation of the appliance. The containers described above generally direct fluid additives into a gap defined between the wash tub and the wash basket. However, the location of the gap relative to the containers can change, particularly when the wash basket is spinning and the washing machine is operating out of level. In turn, fluid additive intended to be directed into the gap between the wash tub and wash basket can spill out of the appliance or onto articles in the wash basket when the shape of the gap changes. For example, bleach intended to be directed into the gap can damage clothing articles if the bleach is applied directly onto the articles in the wash basket rather than entering the gap between the wash tub and wash basket.

In particular, such containers may provide a time-delay functionality, whereby additive may be stored in a reservoir of the container prior to a wash cycle and the washing machine appliance configured to add water to the reservoir at a desired time during the wash cycle until the additive and water mixture are drawn from the reservoir, e.g., by a siphon valve. In some instances, the storage capacity of the reservoir may be overcome, such as when a user adds too much additive or when the inflow rate of water is much greater than the rate at which fluid is siphoned out of the reservoir. Thus, an overflow feature may be provided in the container for directing excess fluid into the wash tub. However, the outlet of the overflow feature may be located away from the primary outlet of the container, making overflow more likely to miss the gap, resulting in higher rates of fluid that is intended to be directed into the gap between the wash tub and wash basket spilling out of the appliance or onto articles in the wash basket in overflow conditions.

Accordingly, a washing machine appliance with features for improved handling of fluid additives would be useful. In particular, a washing machine appliance with features for more reliably directing fluid additives into a small accurate target zone within a gap between a wash basket and a wash tub of the appliance, even in the event of an overflow, would be useful.

BRIEF DESCRIPTION OF THE INVENTION

The present subject matter provides a fluid additive dispenser. As used herein, the terms "additive" or "fluid additive" generally refer to fluids other than water, such as detergent, bleach, fabric softener and/or other such laundry treatment chemicals. Additional aspects and advantages of the invention will be set forth in part in the following description, or may be apparent from the description, or may be learned through practice of the invention.

In a first exemplary embodiment, a washing machine appliance is provided. The washing machine appliance includes a cabinet defining a vertical direction. The cabinet includes a top panel that defines an opening, a wash tub mounted within the cabinet and configured for containing fluid during operation of the washing machine appliance, a wash basket rotatably mounted within the wash tub, the wash tub and the wash basket defining a gap between the wash tub and the wash basket, and a fluid additive dispenser positioned adjacent the wash tub and the wash basket. The fluid additive dispenser comprising a reservoir defining an additive inlet, the additive inlet positioned at the opening of the top panel, a water inlet conduit coupled to the reservoir, a siphon tube comprising a siphon tube inlet and a siphon tube outlet, and a siphon cap surrounding the siphon tube such that a siphon passage is defined between an inner surface of the siphon cap and an outer surface of the siphon tube for siphoning liquid from the reservoir to the siphon tube inlet, the siphon cap comprising an overflow inlet in fluid communication with the siphon tube outlet.

In a second exemplary embodiment, a fluid additive dispenser is provided. The fluid additive dispenser includes a reservoir defining an additive inlet, a water inlet conduit coupled to the reservoir, a siphon tube comprising a siphon tube inlet and a siphon tube outlet, and a siphon cap surrounding the siphon tube such that a siphon passage is defined between an inner surface of the siphon cap and an outer surface of the siphon tube for siphoning liquid from the reservoir to the siphon tube inlet. The siphon cap comprising an overflow inlet in fluid communication with the siphon tube outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 shows fluid additive dispensers according to an exemplary embodiment of the present subject matter mounted above a wash basket and a wash tub of the exemplary washing machine appliance;

DETAILED DESCRIPTION

Figure 1:
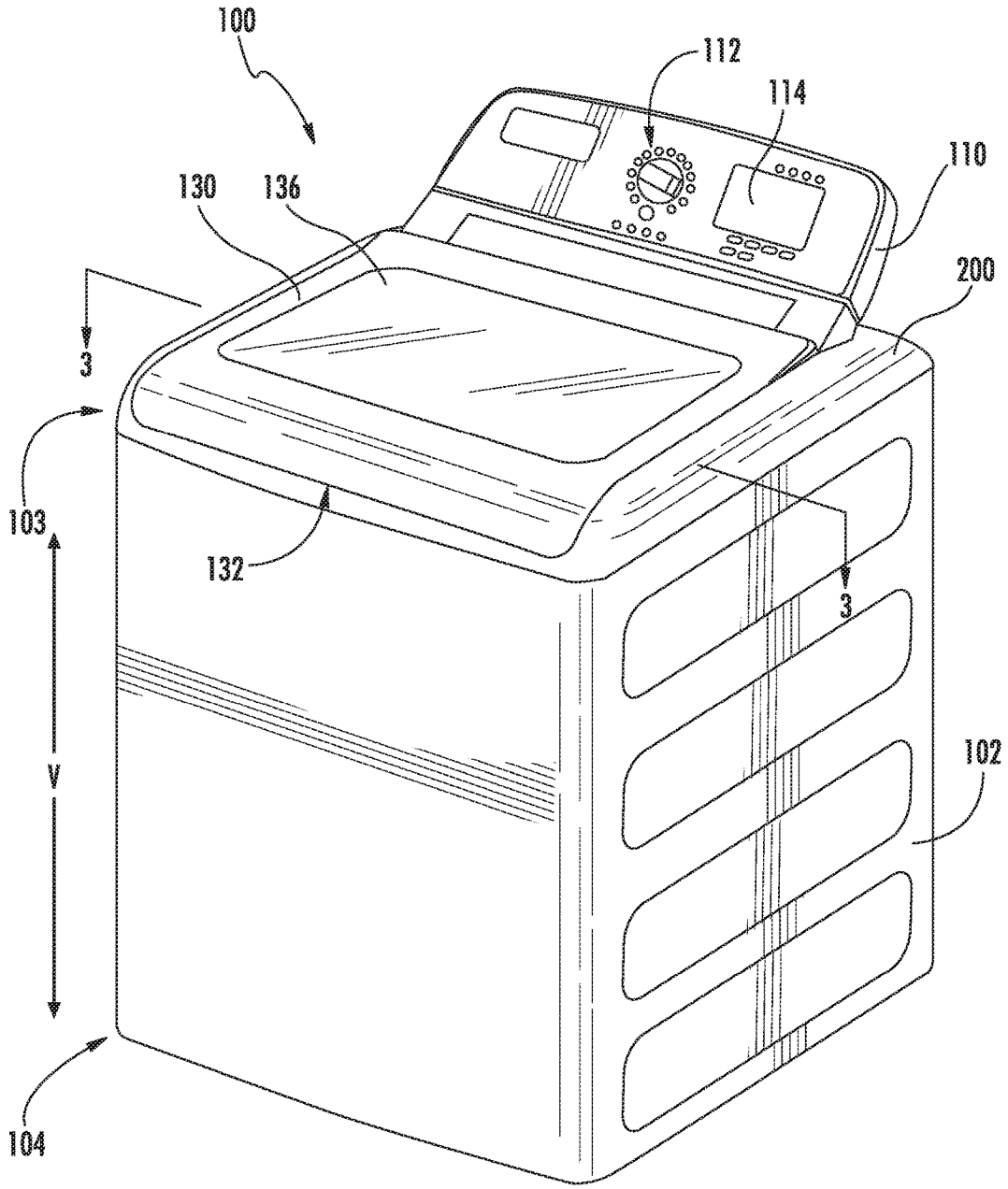
FIG. 1 provides a perspective view of an exemplary appliance, which is illustrated as a washing machine appliance with a door of the washing machine appliance shown in a closed position, that may incorporate various embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
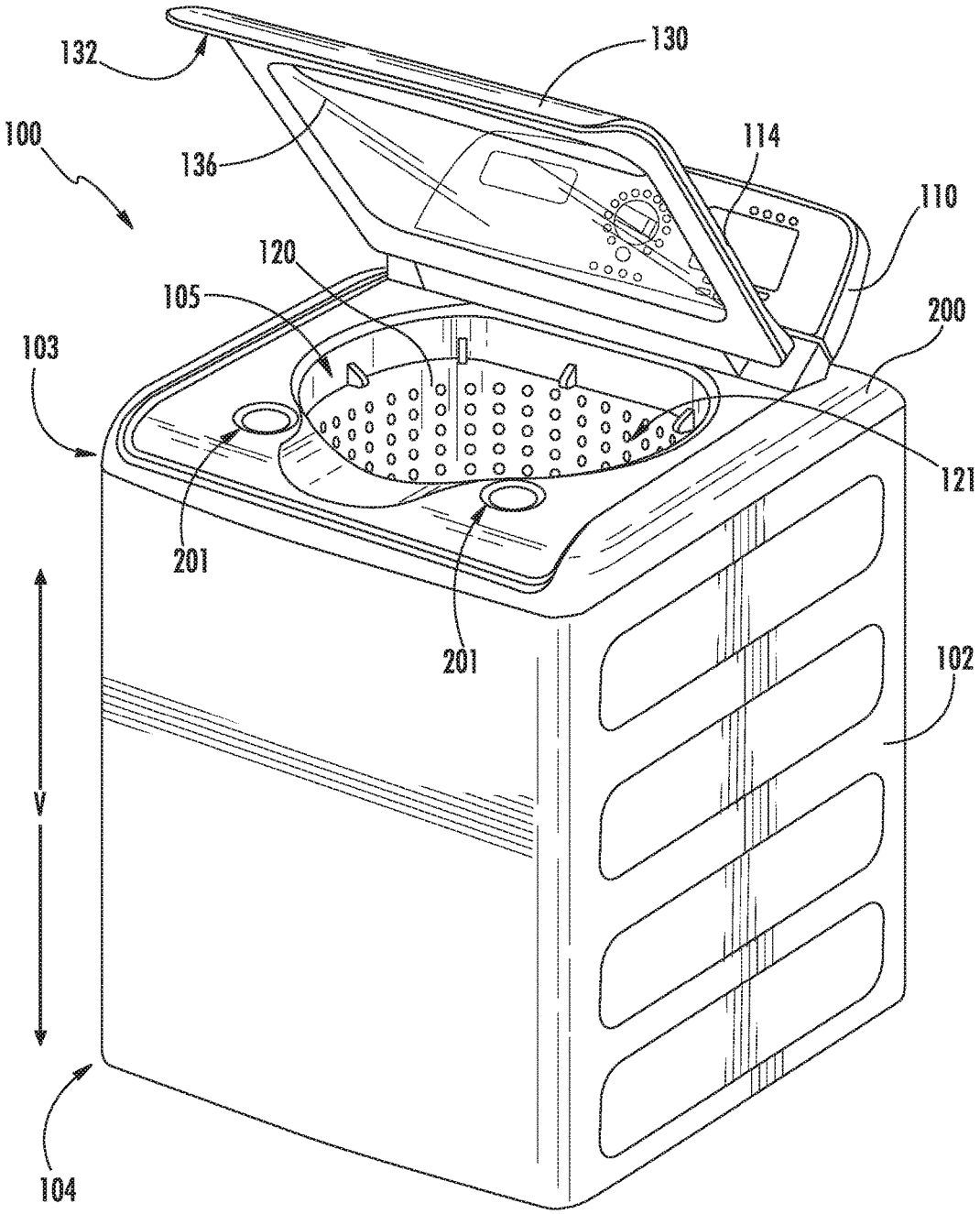
FIG. 2 provides a perspective view of the exemplary washing machine appliance of FIG. 1 with a door of the washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller 140 (FIG. 3) extends from wash basket 120 into wash chamber 121. Impeller 140 assists agitation of articles disposed within wash chamber 121 during operation of washing machine appliance 100.

Cabinet 102 of washing machine appliance 100 has a top panel 200. Top panel 200 defines an opening 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top panel 200 defines a plurality of holes or openings 201 (FIG. 2). Plurality of openings 201 are configured for receipt of a plurality of fluid additives, e.g., detergent, fabric softener, and/or bleach. In some embodiments, each one of the plurality of openings 201 may be configured for receipt of a particular one of the plurality of fluid additives. Plurality of openings 201 permit the plurality of fluid additives to pass through top panel 200 to a fluid additive dispenser 210 (FIG. 3) disposed below top panel 200 along the vertical direction V. Fluid additive dispenser 210 is described in greater detail below.

A control panel 110 with a plurality of input selectors 112 (FIG. 1) extends from top panel 200. Control panel 110 and input selectors 112 collectively form a user interface input for operator selection of machine cycles and features. A display 114 of control panel 130 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items may be loaded into wash chamber 121 through opening 105, and washing operation may be initiated through operator manipulation of input selectors 112. Wash basket 120 (or wash tub 119 shown in FIG. 3) may be filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated (e.g., with impeller 140 shown in FIG. 3) for cleansing of laundry items in wash basket 120.

After the agitation phase of the wash cycle is completed, wash basket 120 may be drained. Laundry articles can then be rinsed by again adding fluid to wash basket 120, depending on the particulars of the cleaning cycle selected by a user, impeller 140 may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through opening 105.

Figure 3:
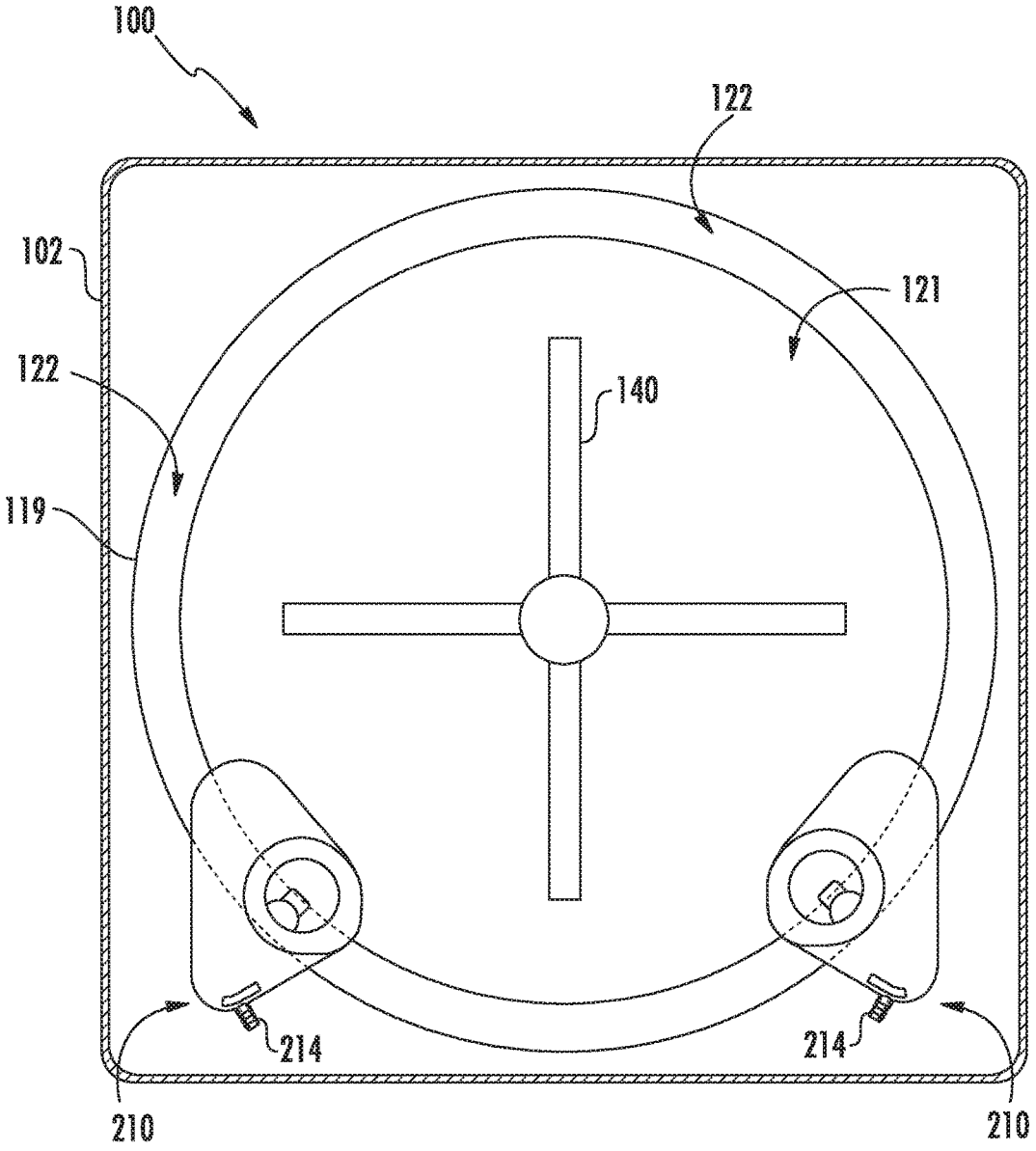
FIG. 3 provides a plan view of the exemplary washing machine appliance of FIG. 1 taken along the 3-3 line shown in FIG. 1.

FIG. 3 is a plan view of washing machine appliance 100 taken along the 3-3 line shown in FIG. 1. An exemplary embodiment of fluid additive dispenser 210 is shown mounted above wash basket 120 and a wash tub 119 of washing machine appliance 100. As may be seen in FIG. 3, wash basket 120 is mounted within wash tub 119. In particular, wash basket 120 is rotatably mounted within wash tub 119 such that wash basket 120 is spaced apart from wash tub 119. In turn, wash tub 119 may be mounted to cabinet 102, e.g., using springs or dampers (not shown) in order to reduce vibration of washing machine appliance 100 during rotation of wash basket 120. Such dampers or springs may permit wash tub 119 and wash basket 120 to displace or shift within cabinet 102. As an example, wash tub 119 and wash basket 120 may displace or shift within cabinet 102 due to an imbalance in the distribution of articles within wash basket 120 or due to washing machine appliance 100 operating in an out-of-level configuration.

Wash tub 119 is configured for containing wash and rinse fluids during operation of washing machine appliance 100 described above. Wash and rinse fluids disposed within wash tub 119 can be used to clean articles disposed in wash basket 120. Wash and rinse fluids can pass between wash basket 120 and wash tub 119 through a plurality of apertures defined by wash basket 120, e.g., during the wash and/or spin cycles described above.

Fluid additive dispensers 210 are mounted above wash tub 119 and wash basket 120 (e.g., along the vertical direction V shown in FIG. 1). More particularly, fluid additive dispensers 210 may be mounted above a gap 122 (e.g., along the vertical direction V shown in FIG. 1). Gap 122 is defined between wash tub 119 and wash basket 120 and may correspond the radial space between wash tub 119 and wash basket 120. Fluid additive dispensers 210 are configured for receipt of fluid additives from plurality of holes 201 (FIG. 2). Fluid additive dispensers 210 are also configured for directing the fluid additives into gap 122. For example, fluid additive dispensers 210 may direct detergent into gap 122 prior to a wash cycle of washing machine appliance 100. Similarly, fluid additive dispensers 210 may direct fabric softener into gap 122 prior to a rinse cycle of washing machine appliance 100.

As will be understood by those skilled in the art, gap 122 changes location within cabinet 102, e.g., relative to fluid additive dispensers 210 during operation of washing machine appliance 100. In particular, gap 122 will shift or displace when wash tub 119 and wash basket 120 shift or displace within cabinet 102 during rotation of wash basket 120 described above.

However, the range of travel of the wash tub 119 and wash basket 120 can be limited by the dampers or springs that mount the wash tub 119 to cabinet 102. Displacement of gap 122 is similarly limited by the dampers or springs, e.g., during operation of the washing machine appliance 100. Fluid additive dispenser 210 is disposed above (e.g., along the vertical direction V shown in FIG. 1) a small target zone generally within the range of movement of gap 122 during operation of washing machine appliance 100 so as to avoid or minimize displacement of gap 122 away from dispenser 210. In other words, dispenser 210 is positioned for accurately directing fluid into a small target zone which the gap does not or is most likely to not displace away from during operation of washing machine appliance 100. Additionally, in some embodiments, deflectors (not shown) may be provided under the dispensers 210 to assist directing fluid into gap 122. In such configurations, fluid additives are more likely to be directed into gap 122 rather than into wash basket 120 or out of wash tub 119. By positioning fluid additive dispenser 210 in such a manner, potential damage to articles in wash basket 120 due to misdirected fluid additives can be avoided and spills of fluid additives can also be limited.

Figure 4:
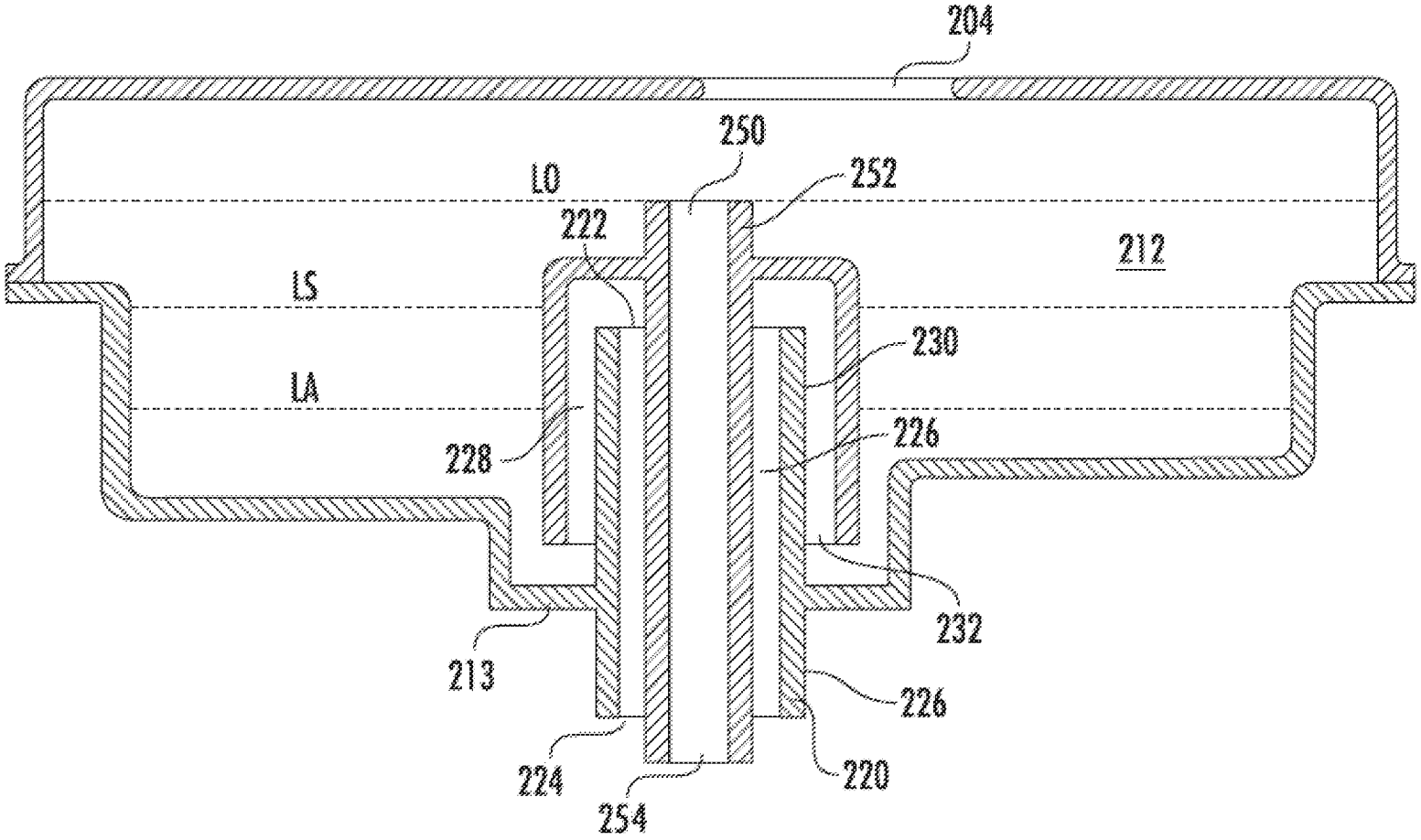
FIG. 4 provides a section view of a fluid additive dispenser according to an exemplary embodiment of the present subject matter.
Figure 5:
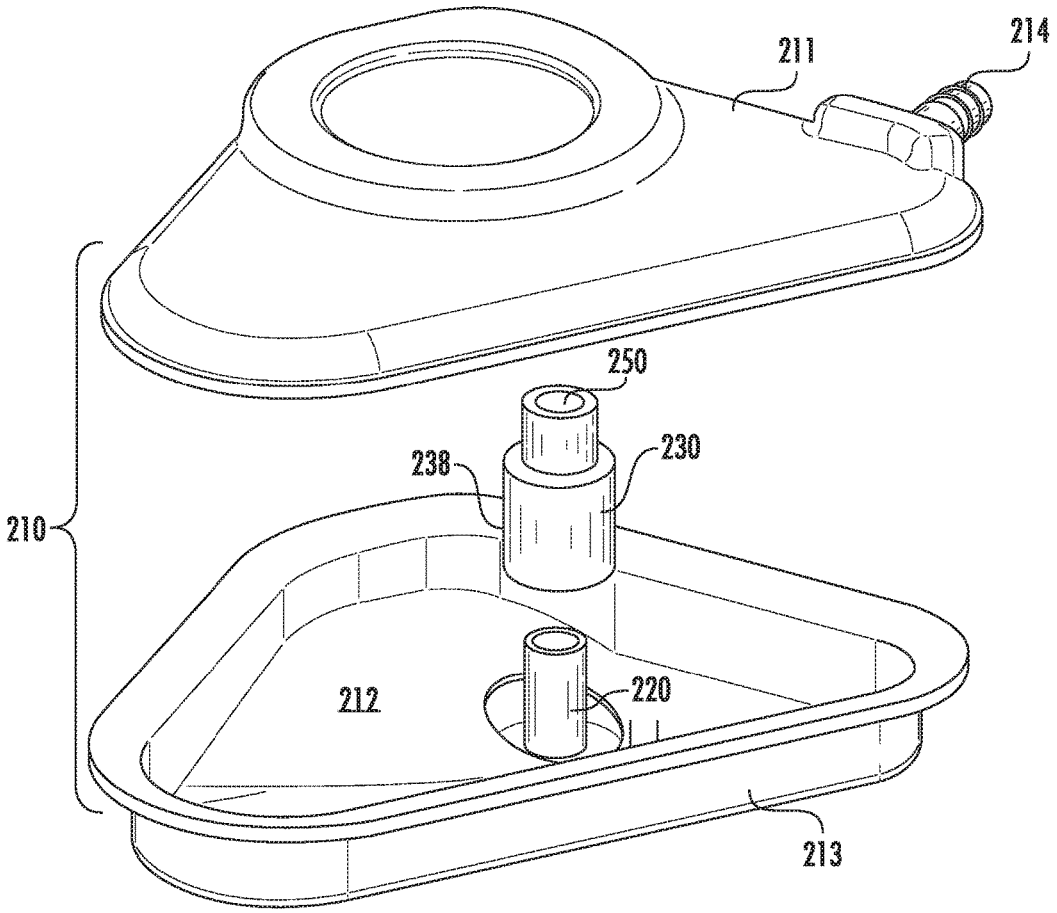
FIG. 5 provides an exploded view of the exemplary fluid additive dispenser of FIG. 4.

FIG. 4 is a section view of one of fluid additive dispensers 210. FIG. 5 is an exploded view of such fluid additive dispenser 210. Fluid additive dispenser 210 may be constructed of any suitable material. For example, fluid additive dispenser 210 may be constructed of a plastic, a metal, or a combination of materials.

As may be seen in FIGS. 4 and 5, fluid additive dispenser 210 includes a reservoir 212 with an additive inlet 204 defined therein. The additive inlet 204 may be positioned at the opening 201 of the top panel 200. Additive inlet 204 may be aligned with and disposed below one of plurality of openings 201 of top panel 200 (FIG. 2). As an example, a user can pour detergent through the one of plurality of openings 201 such that the detergent passes into reservoir 212 through additive inlet 204. Reservoir 212 also includes a water inlet 202 (FIG. 4) coupled to water inlet conduit 214 (FIG. 3). Water inlet conduit 214 is in fluid communication with a water source (not shown), e.g., using a hose or other conduit. Water inlet 202 directs a selective flow of water into reservoir 212. The water inlet 204 and the additive inlet 204 are positioned above a siphon cap inlet 232 (discussed in more detail below) along the vertical direction V, such that water, additive, and/or a mixed solution containing both water and additive, may flow by gravity to the siphon cap inlet 232 within reservoir 212.

Fluid additive dispenser includes siphon tube 220 and siphon cap 230. Siphon tube 220 comprises a siphon tube inlet 222 and a siphon tube outlet 224 spaced apart along the vertical direction V with siphon tube outlet 224 vertically below siphon tube inlet 222. Siphon tube outlet 224 may preferably be positioned for directing additive and/or water from reservoir 212 into gap 122 (FIG. 3), as described above. The siphon cap 230 is positioned above and around the siphon tube such that an inlet 232 of the siphon cap 230 is positioned below the siphon tube inlet 222 along the vertical direction V and the top wall 236 of the siphon cap is positioned above the siphon tube inlet 222 along the vertical direction V. In this arrangement, siphon cap 230 and siphon tube 220 are juxtaposed along the vertical direction V such that they are partially overlapped vertically, and a narrow gap remains therebetween, e.g., defining a siphon passage 228 between an inner surface 240 (FIG. 6) of the siphon cap 230 and an outer surface 226 of the siphon tube 220 for siphoning liquid out of the reservoir 212 from an inlet 232 of the siphon cap 230 to an inlet 222 of the siphon tube 220. In some exemplary embodiments, siphon tube 220 and siphon cap 230 may be cylindrical and collectively define a longitudinal direction, a radial direction perpendicular to the longitudinal direction, and a circumferential direction that extends around a longitudinal axis of the cylindrical siphon tube 220 and siphon cap 230. In such embodiments, the width of the siphon passage 228 defined between an inner surface 240 of the siphon cap 230 and an outer surface 226 of the siphon tube 220 may lie along the radial direction.

Siphon passage 228 regulates the flow of fluid additive out of reservoir 212. As an example, an additive may be placed in the reservoir 212 prior to the initiation of a wash cycle. Such additive can be stored in the reservoir up to about additive level LA, which is below siphon tube inlet 222, and will flow by gravity to siphon cap inlet 232, but will not reach siphon tube inlet 222. During operation of the wash cycle, and in some exemplary embodiments, at a particular desired step of the wash cycle, which may depend on the type of additive, a flow of water into reservoir 212 can be initiated through water inlet 202. Such water can mix with fluid additive within reservoir 212 and fill reservoir 212 to a particular level, such as at or about siphon level LS, at which point a siphon is formed between inlet 232 in siphon cap 230 and siphon tube inlet 222 along siphon passage 228, so that reservoir 212 is at least partially drained of the water and fluid additive solution.

The siphon cap 230 also includes an overflow inlet 250 in fluid communication with the siphon tube outlet 224. Overflow inlet 250 is configured for directing fluid from reservoir 212 to gap 122. In particular, overflow inlet 250 prevents reservoir 212 from filling with an excessive volume of liquid. Overflow inlet 250 is provided so that reservoir 212 will not overflow in an uncontrolled manner, for example if siphon passage 228 fails to operate or operates slowly.

Siphon cap 230 generally includes a cylindrical body 238 and a top wall 236. The cylindrical body 238 includes a first open end 232 positioned at a bottom wall 213 of the reservoir 212. The top wall 236 extends radially inward from a second end 234 of the cylindrical body 238, the second end 234 opposing the first end 232. The top wall 236 of the siphon cap 230 is positioned over the siphon tube 220 (FIG. 4).

Figure 6:
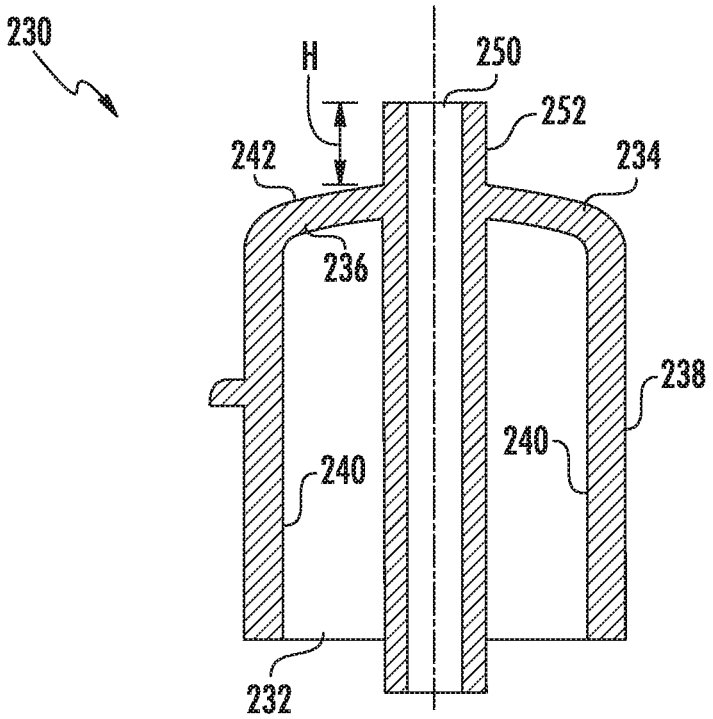
FIG. 6 provides a section view of a siphon cap according to an exemplary embodiment of the present subject matter.

As may be seen in FIGS. 4 and 6, in some embodiments, siphon cap 230 may include an overflow conduit 252, which may extend above and/or below the siphon cap 230. In some other exemplary embodiments overflow conduit 252 may be generally coextensive with a top wall 236 of siphon cap 230. Thus, in some embodiments, the overflow inlet 250 of the siphon cap 230 may be positioned above the top wall 236 of the siphon cap 230 along the vertical direction V, while in other embodiments the overflow inlet 250 may be formed in an upper surface 242 of the top wall 236 of the siphon cap 230. In some embodiments such as the examples illustrated in FIGS. 4 and 6, the siphon cap 230 may include an overflow conduit 252 extending from the overflow inlet 250 and through the top wall 236 of the siphon cap 230, and in some exemplary embodiments the overflow conduit 252 may partially overlap and be disposed within siphon tube 220 (FIG. 4).

Fluid additive dispenser 210 is in fluid communication with wash tub 119 and wash basket 120 for adding fluids, e.g. fabric softener or bleach, to wash tub 119. In particular, fluid additive dispenser 210 may include only one outlet in fluid communication with the wash tub 119 and wash basket 120, i.e., siphon tube outlet 224. Thus, the fluid additive dispenser 210 is in fluid communication with the wash tub 119 and the wash basket 120 only via the siphon tube outlet 224. For example, the overflow inlet 250 does not have a separate outlet into the wash tub 119 and/or wash basket 120 other than the siphon tube outlet 224. As a result, the ability of the fluid additive dispenser 210 to dispense fluids into the gap 122, even when gap 122 may vary as described above, is improved relative to a dispenser with multiple outlets.

The volume of liquid within the reservoir 212, which may include water and/or additives in varying amounts or compositions, will have at least two predetermined levels, a siphoning level (LS) at which siphoning starts (as described above) and an overflow level (LO), at which overflow starts. In other words, when reservoir 212 is filled such that the liquid level reaches siphoning level LS, liquid will begin to flow along siphon passage 228 from siphon cap inlet 232 to siphon tube inlet 222. As such, the reservoir 212 has a maximum fluid storage capacity, which is generally defined by the volume of reservoir 212 below the siphoning level LS. When reservoir 212 is filled such that the liquid level reaches at or about overflow level LO, liquid will begin to flow out of reservoir 212 via overflow inlet 250 as well as or instead of via siphon passage 228. Liquid entering overflow inlet 250 will flow by gravity from overflow inlet 250 to siphon tube outlet 224. In some exemplary embodiments, such as illustrated in FIG. 4, overflow liquid will flow by gravity from overflow inlet 250 through overflow conduit 252 to an overflow outlet 254. Also as illustrated in FIG. 4, in some embodiments, overflow outlet 254 may extend below siphon tube outlet 224 in the vertical direction. Siphon cap inlet 232 is positioned below siphon tube inlet 222, e.g., siphon cap inlet 232 may be positioned proximate to a bottom wall 213 of the reservoir 212 while siphon tube 220 extends above the bottom wall 213 of the reservoir 212 by some distance along the vertical direction. The vertical distance between siphon cap inlet 232 and siphon tube inlet 222 defines a length of the siphon passage 228. The siphoning level LS is predetermined at least in part by the vertical distance between siphon cap inlet 232 and siphon tube inlet 222. Thus, a fluid storage capacity of the reservoir 212 is determined by a length of the siphon passage 228 along the vertical direction V.

As may be seen in FIGS. 4 and 5, in some exemplary embodiments fluid additive dispenser may be 210 formed of two separate pieces, generally referred to as a cover 211 and a cup 213. As may be seen in FIGS. 4 through 6, siphon cap 230 may be integrally formed as a unitary piece, which may, in applicable embodiments, include overflow conduit 252. Siphon cap 230 may be formed separately from cover 211 and cup 213. Suitable materials for fluid additive dispenser 210 may include plastic materials. Multipart construction of fluid additive dispenser 210 as described herein may be accomplished using parts 211, 213, and 230 of molded plastic. In other exemplary embodiments, parts 211, 213, and 230, may collectively be integrally formed as a unitary part, e.g., using additive manufacturing techniques.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fluid additive dispenser for a washing machine appliance, the fluid additive dispenser comprising:
- a reservoir defining an additive inlet;
- a water inlet conduit coupled to the reservoir;
- a siphon tube comprising a siphon tube inlet and a siphon tube outlet; and
- a siphon cap surrounding the siphon tube such that a siphon passage is defined between an inner surface of the siphon cap and an outer surface of the siphon tube for siphoning liquid from the reservoir to the siphon tube inlet, the siphon cap comprising
  - an overflow inlet in fluid communication with the siphon tube outlet, and
  - an overflow conduit extending from the overflow inlet, the overflow conduit disposed at least partially within the siphon tube.

2. The fluid additive dispenser of claim 1, wherein the siphon cap comprises a cylindrical body and a top wall, a first open end of the cylindrical body positioned at a bottom wall of the reservoir, and the top wall extending radially inward from a second opposing end of the cylindrical body, the top wall positioned over the siphon tube.

3. The fluid additive dispenser of claim 2, wherein the cylindrical body comprises a longitudinal axis defining a longitudinal direction, the first open end of the cylindrical body and the second opposing end of the cylindrical body are spaced apart along the longitudinal direction.

4. The fluid additive dispenser of claim 2, wherein the overflow conduit of the siphon cap extends from the top wall of the siphon cap such that the overflow inlet is positioned above the top wall of the siphon cap along the longitudinal direction.

5. The fluid additive dispenser of claim of claim 3, wherein the siphon cap further comprises a siphon inlet for the siphon passage, and wherein the siphon cap inlet is positioned below the siphon tube inlet along the longitudinal direction.

6. The fluid additive dispenser of claim of claim 1, wherein the overflow inlet is formed in an upper surface of the top wall of the siphon cap.

7. The fluid additive dispenser of claim of claim 1, wherein the siphon cap further comprises a siphon cap inlet for the passage, and wherein the water inlet conduit and the additive inlet are positioned above the siphon cap inlet along the longitudinal direction.

8. The fluid additive dispenser of claim of claim 1, wherein a fluid storage capacity of the reservoir is determined by a length of the siphon passage along the longitudinal direction.

9. The fluid additive dispenser of claim 1, wherein the overflow conduit is concentric to the siphon tube.

10. A washing machine appliance comprising:

a cabinet defining a vertical direction, the cabinet having a top panel that defines an opening;

a wash tub mounted within the cabinet and configured for containing fluid during operation of the washing machine appliance;

a wash basket rotatably mounted within the wash tub, the wash tub and the wash basket defining a gap between the wash tub and the wash basket;

a fluid additive dispenser positioned adjacent the wash tub and the wash basket, the fluid additive dispenser comprising:

a reservoir defining an additive inlet, the additive inlet positioned at the opening of the top panel;

a water inlet conduit coupled to the reservoir;

a siphon tube comprising a siphon tube inlet and a siphon tube outlet; and a siphon cap surrounding the siphon tube such that a siphon passage is defined between an inner surface of the siphon cap and an outer surface of the siphon tube for siphoning liquid from the reservoir to the siphon tube inlet, the siphon cap comprising an overflow inlet in fluid communication with the siphon tube outlet, and an overflow, conduit extending from the overflow inlet through the siphon tube.

11. The washing machine appliance of claim 10, wherein the siphon cap comprises a cylindrical body and a top wall, a first open end of the cylindrical body positioned at a bottom wall of the reservoir, and the top wall extending radially inward from a second opposing end of the cylindrical body, the top wall positioned over the siphon tube.

12. The washing machine appliance of claim 11, wherein the overflow inlet of the siphon cap is positioned above the top wall of the siphon cap along the vertical direction.

13. The washing machine appliance of claim 11, wherein the overflow conduit of the siphon cap extends from the top wall of the siphon cap such that the overflow inlet is positioned above the top wall of the siphon cap along the vertical direction.

14. The washing machine appliance of claim 10, wherein the overflow inlet is formed in an upper surface of the top wall of the siphon cap.

15. The washing machine appliance of claim 10, wherein an inlet of the siphon cap is positioned below the siphon tube inlet along the vertical direction and the top wall of the siphon cap is positioned above the siphon tube inlet along the vertical direction.

16. The washing machine appliance of claim 15, wherein the water inlet conduit and the additive inlet are positioned above the siphon cap inlet along the vertical direction.

17. The washing machine appliance of claim 10, wherein the fluid additive dispenser is in fluid communication with the wash tub and the wash basket only via the siphon tube outlet.

18. The washing machine appliance of claim 10, wherein the siphon tube outlet is positioned above the gap between the wash tub and the wash basket along the vertical direction for directing fluid into the gap between the wash tub and the wash basket.

19. The washing machine of claim 10, wherein a fluid storage capacity of the reservoir is determined by a length of the siphon passage along the vertical direction.

20. The washing machine appliance of claim 10, wherein the overflow conduit is concentric to the siphon tube.

* * * * *